United States Patent [19]

Piget

[11] 3,967,427

[45] July 6, 1976

[54] COMPLEX LIGHT METAL FRAMEWORK PRODUCED BY COMBINING SECTIONAL PIECES INTERCONNECTED IN A DETACHABLE MANNER BY MEANS OF FLEXIBLE STRIPS HAVING A NOVEL STRUCTURE

[76] Inventor: Maurice Piget, Boisset-les-Prevanches, (Eure), France

[22] Filed: Sept. 6, 1974

[21] Appl. No.: 503,573

[52] U.S. Cl. ..... 52/502; 52/282; 52/476; 52/495; 52/501; 52/628; 52/729

[51] Int. Cl.[2] ..... E04B 2/58

[58] Field of Search ..... 52/499, 500, 501, 502, 52/497, 760, 729, 732, 498, 282, 285, 508, 481, 628, 476, 495

[56] References Cited

UNITED STATES PATENTS

| | | | |
|---|---|---|---|
| 871,318 | 11/1907 | Biscoff | 52/502 |
| 1,596,360 | 8/1926 | Krey | 52/729 |
| 2,101,952 | 12/1937 | Olsen | 52/481 X |
| 2,169,253 | 8/1939 | Kotrbaty | 52/497 |
| 2,205,725 | 6/1940 | Kavanagh | 52/481 |
| 2,612,244 | 9/1952 | Kiefer | 52/498 |
| 2,897,620 | 8/1959 | Fitzgerald | 52/760 |
| 3,190,408 | 6/1965 | Petterson | 52/282 X |
| 3,310,923 | 3/1967 | DeRidder | 52/497 |
| 3,456,409 | 7/1969 | Piget | 52/282 |
| 3,590,543 | 7/1971 | Heirich | 52/489 |
| 3,798,865 | 3/1974 | Curtis | 52/760 |

FOREIGN PATENTS OR APPLICATIONS

| | | | |
|---|---|---|---|
| 1,175,857 | 8/1964 | Germany | 52/498 |
| 403,258 | 8/1966 | Switzerland | 52/498 |
| 979,847 | 1/1965 | United Kingdom | 52/498 |

*Primary Examiner*—Alfred C. Perham
*Attorney, Agent, or Firm*—Sughrue, Rothwell, Mion, Zinn & Macpeak

[57] ABSTRACT

A multi-piece complex metal framework is disclosed wherein first and second pieces are retained in clamping relationship by the force exerted by a third, resilient strip inserted between the first and second pieces. The framework may be used to clamp and retain a sheet-like article, and to fabricate structural beams having means to retain sheet-like article.

7 Claims, 14 Drawing Figures

COMPLEX LIGHT METAL FRAMEWORK PRODUCED BY COMBINING SECTIONAL PIECES INTERCONNECTED IN A DETACHABLE MANNER BY MEANS OF FLEXIBLE STRIPS HAVING A NOVEL STRUCTURE

FIELD OF INVENTION

The invention relates to complex metal framework for use in fabricating structural members having means to clamp sheet-like articles thereto.

PRIOR ART

In the construction industry interlocking supporting elements are produced by mounting the cross-pieces on the limb elements by means of bolts, by welding or by means of screws. This assembly method involves high machining costs and does not enable the elements to be separated and reused. This assembly method also has the serious disadvantage that its rigidity causes stresses which are the source of local deformation and which are caused by the different expansion coefficients of the materials which have been combined. This phenomenon of expansion has lead construction engineers to develop an assembly method in which each part expands or contracts on its own without affecting the adjacent parts. This is the solution which the present invention seeks to employ in providing an assembly implementing a sectional piece having three cavities of trapezoidal section, the central cavity having a trapezoidal section in the form of an isoceles, and the two side cavities having a trapezoidal section in the form of a rectangle. This assembly also employs flexible strips having a novel structure.

A flexible strip comprising three rectangular parts of unequal length which exerts its stress perpendicular to the median plane and causes the end edge of its short part to be anchored in position by reaction, is already known. A flexible strip of this type is always combined with a sectional piece having a rectangular cavity with its opening partially closed so as to retain the deformable strip therein. This strip clears the opening in its flattened form but is unable to do so in the retracted form it adopts in its work position.

SUMMARY OF THE INVENTION

The three-part novel flexible strip according to the invention which is combined with a sectional piece having three cavities of trapezoidal section differs from the known flexible strip by the wedge form of its short part the end edge of which has the same slant as that of the slanting side of the trapeze forming the upright section of the cavity in which the flexible strip is engaged. After being inserted into the cavity through its narrow mouth and after being stressed, the flexible strip is prevented from sliding transversally. On the other hand, by not providing the long part with the same slant which would cause it to coincide with the slanting wall, bending of the longer part is produced, the end of this longer part only being in contact with the slanting wall at its tip on the side of the small base of the trapeze, the bending action increasing the anchorage of the acute-angled tip of the short part.

The object of a first application is to secure a window pane by means of a combination of the first sectional piece comprising three cavities as shown in FIG. 1 and the second sectional piece shown in FIG. 2 which acts as a clamping fixture.

DETAILED DESCRIPTION OF THE PREFERRED EMBODIMENT

Figure 1:
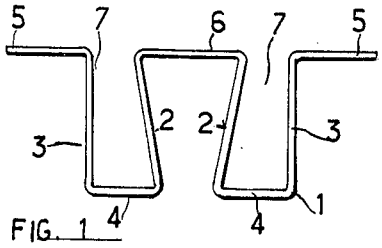
FIG. 1 is an end view of the main sectional piece of a complex metal framework according to the present invention.
Figure 2:
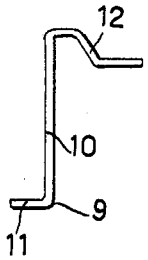
FIG. 2 is an end view of the secondary sectional piece of a complex metal framework according to the present invention.

The main sectional piece comprises a central cavity having a trapezoidal section in the form of an isoceles, the two slanting walls 2 of which are each common to two lateral cavities having a trapezoidal section in the form of a rectangle comprising a wall 3 perpendicular to their base 4. The sectional piece 1 comprising the three cavities also comprises two bent edges 5 perpendicular to the walls 3.

The secondary sectional piece 9 comprises three parts, the lower part II being perpendicular to the main part 10 and the upper part 12 being Z-shaped.

Figure 3:
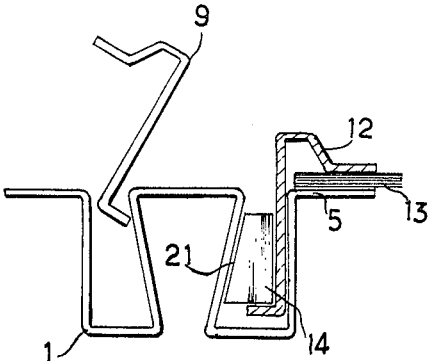
FIG. 3 is an end view of one embodiment of the assembled complex metal framework according to the present invention.
Figure 4:
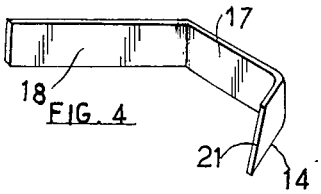
FIG. 4 is a perspective view of the flexible strip shown in FIG. 3.

As may be seen in FIG. 3, the secondary sectional piece 9 is inserted into the mouth of one of the lateral cavities, the upper part 12 securing the glass 13 which rests on the edge section 5 of the main sectional piece. The secondary sectional piece 9 is secured by a triple-section flexible strip of novel structure which, as shown in FIG. 4, comprises a short section 14, the end edge of which has the same slant as that of the slanting wall 2 of the cavities of the main sectional piece. Owing to this slant, the short section 14 is wedged in the lateral cavity, thereby securing it in position. As in the case of the known flexible strip, the novel flexible strip comprises a median bearing part 17 and a long part 18 acting as a lever for engagement in the cavity of the sectional piece, the three elements 14, 17, 18, forming obtuse angles of variable amplitude between them.

Figure 5:
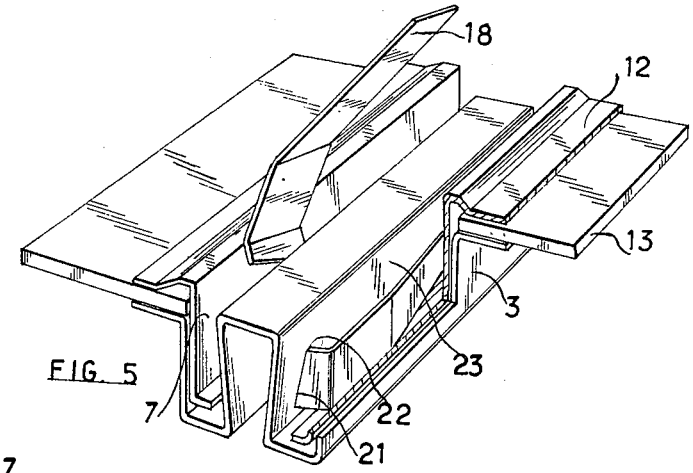
FIG. 5 is a perspective view of one embodiment of a complex metal framework according to the present invention.

FIG. 5 shows a flexible strip according to the invention which is engaged in the left-hand cavity of the main sectional piece. A break of the drawing shows the flexible strip in place in the right-hand lateral cavity holding in position the fixture 9 which secures the window pane 13. It will be noted that the long part 18 (the end part of which does not slant) is subject to a bending stress which is transmitted to the short part 14 and causes the acute-angled tip of the end edge 21 to be held in place in the slanting wall of the cavity thereby securing the same in position.

Figure 6:
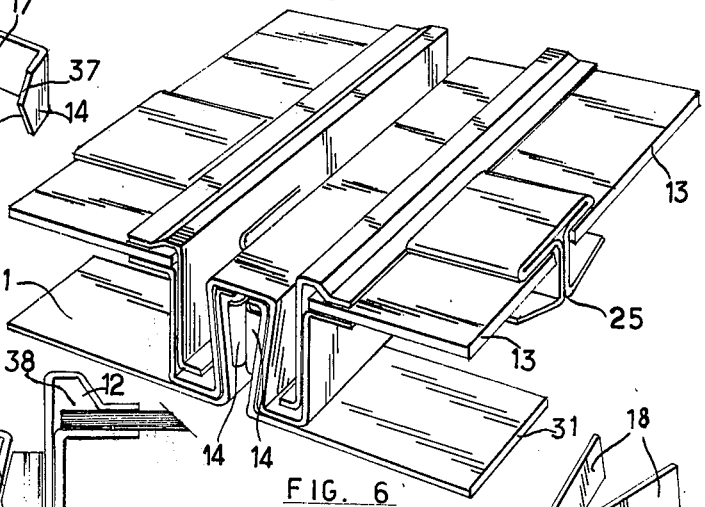
FIG. 6 is a perspective view of a second embodiment of a complex metal framework according to the present invention.
Figure 10:
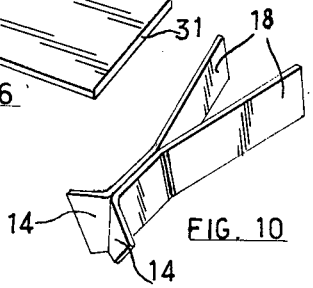
FIG. 10 is a perspective view showing the arrangement of two flexible strips of FIG. 4.
Figure 7:
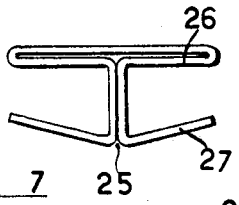
FIG. 7 is an end view of auxiliary structural member for clamping two consecutive cover elements used in FIG. 6.
Figure 8:
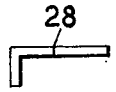
FIG. 8 is an end view of a corner piece for supporting a cover element.
Figure 9:
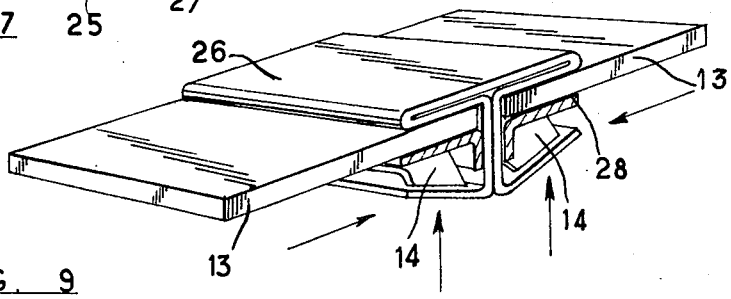
FIG. 9 is a perspective view showing the pieces of FIGS. 7 and 8 in assembled relationship.
Figure 12:
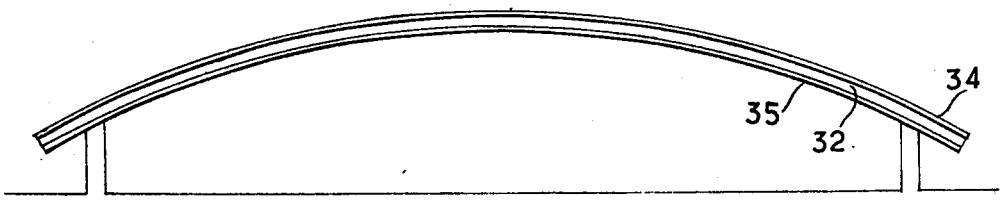
FIG. 12 is a side view of a curved beam assembled according to FIG. 11.

FIG. 6 shows an embodiment of a glazed cover, two elements 13 of which are interconnected by means of a connecting piece 25. A sectional view of this piece 25 is shown in FIG. 7 and a perspective view in FIG. 9. This connecting piece comprises two cavities with opposite narrow mouths. Each cavity is limited at its upper part by a horizontal plane and at its lower part by an oblique plane 27, the glass 13 being held between the plane 26 and a movable plane 28 comprising a curved edge. A sectional view of this plane 28 is represented in FIG. 8. A flexible strip according to the invention is inserted into the gap between the oblique plane 27 and the movable plane 28. A spacer 31 is disposed between two consecutive sectional pieces. The shaped ends of the spacer 31 are engaged in the central cavity of the main sectional piece. Two spacers come together in the central cavity and are held in position by two flexible strips placed back-to-back as shown in FIG. 10.

Figure 11:
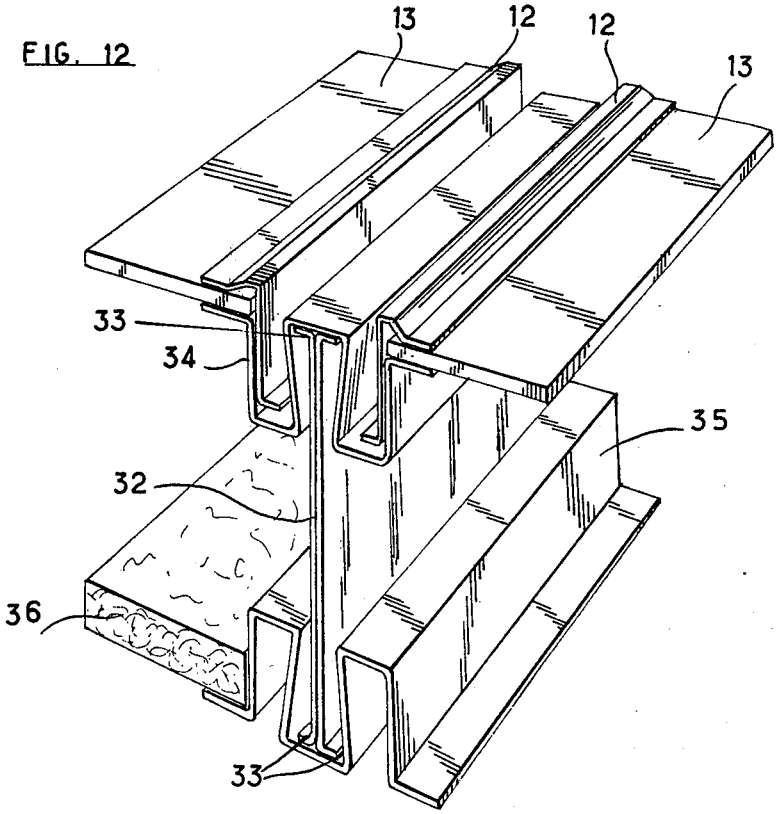
FIG. 11 is a perspective view showing an I-beam structure fabricated from the complex metal framework of the present invention.

The invention may be used to produce a substantially I shaped beam structure. Each of the limbs of this structure consists of a main sectional piece comprising three cavities, the two limbs being inverted such that the openings in the two central cavities are opposite each other and the web of the beam structure consisting of two plates with curved edges disposed back-to-back can engage therein. The web is rigidly connected to each of the two limbs by means of the flexible strips according to the invention which are placed in the central cavities on either side of the web. This embodiment is shown in FIG. 11. Numeral 32 represents the web of the framework and 33 the bent edges of the two plates. The flexible strips placed in the central cavities are not shown. Numeral 34 represents the upper limb which is used to hold the glazed cover 13. Numeral 35 is the lower limb which holds insulating panels 36.

It is possible to bend the sectional pieces of limbs 34 and 35 and also to bend the web 32 to obtain a curved structure. This curved form can also be obtained by initially bending only the web 32. The positioning of connecting clamps between the web and the limb elements will produce the desired curvature of these elements.

Figure 13:
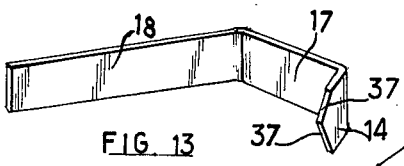
FIG. 13 is a perspective view of a second embodiment of the flexible strips of the present invention.
Figure 14:
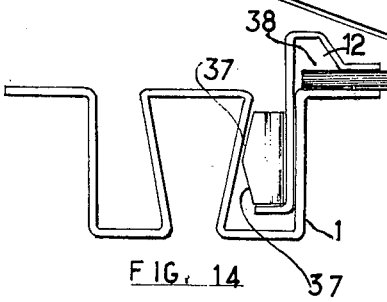
FIG. 14 is an end view showing the flexible strips of FIG. 13 in assembled relationship.

The embodiment of the flexible strip as shown in FIG. 4 where the short section 14 has a slanting end edge 21 shows the need to provide two types of strips with the slant of the tips 21 reversed according to whether the leading or trailing short section 14 is to be engaged in the cavity. To avoid any assembly errors, it is proposed to provide a flexible strip, the end edge of the short part of which comprises a double bevel 37 as shown in FIGS. 13 and 14.

The complex framework has been described in reference to its application as a supporting element for a window pane but it can also be used as a bracing beam for a floor consisting of a combination of concrete and bracing structures. These bracing elements form visible beams and they are provided with a camber which reabsorbs the actual weight of the floor. The particular shape of the limbs of the bracing structure and the presence of connecting elements between the web and the two limbs prevents any slipping of the concrete with respect to the bracing beam even in the case of powerful vibrations.

What is claimed is:

1. A complex metal framework for use in fabricating structural members having means to clamp a sheet like article, said framework comprising:

a. a main sectional piece having a wall defining a plurality of longitudinally extending cavities therein including a central cavity and a plurality of laterally displaced cavities, each lateral cavity having at least one inclined wall, and the central cavity having two inclined walls, each cavity having an open end and a base portion disposed opposite said open end, the width of the open end being less than the width of the base portion;

b. a second sectional piece shape so as to be inserted into one of said cavities such that a first portion of the second sectional piece contacts a portion of the wall defining the cavities and a second portion of the second sectional piece contacts the sheet like article; and c. a resilient flexible strip inserted into said one cavity, said resilient flexible strip having a short section and a long section the ends of which contact the inclined wall of said one cavity, and a median section formed integral with and located between said short and long sections, said median section contacting the second sectional piece inserted into said one cavity so as to bias said second sectional piece against said sheet like article to clamp said article between said second sectional piece and said main sectional piece.

2. The complex metal framework of claim 1 wherein the end of said short section which engages the inclined wall of said main sectional piece has the same angle of inclination as said wall.

3. The complex metal framework of claim 1 wherein the end of said short section which engages the inclined wall of said main sectional piece is formed in a double bevel, each bevel having the same angle of inclination as said wall.

4. The complex metal framework of claim 1 wherein said wall of said main sectional piece defines three longitudinal cavities, a central cavity having a generally trapezoidal cross-section, the inclined sidewalls of said central cavity also forming one sidewall of each of said adjacent cavities, the remaining sidewalls of said adjacent cavities being parallel to each other and perpendicular to the respective bases of said adjacent cavities.

5. A complex metal framework having an I-shaped cross-section comprising:

a. upper and lower limb portions, each limb portion having three longitudinal cavities defined by an integral wall, the central cavity having two inclined walls;

b. a web portion comprising two generally U shaped plates placed back to back, the longitudinal edges inserted into the central cavity of each of the upper and lower limb portions; and c. a resilient, flexible wedge strip inserted into each central cavity said resilient, flexible wedge strip having a short section, and a long section, the ends of which contact an inclined wall of the cavity, and a median section formed integral with and located between said short and long sections, said median section contacting said web so as to retain the web portion in said cavity.

6. The complex metal framework of claim 5 wherein the central cavity of the upper and lower limb portions is of a generally tapezoidal cross-section.

7. A complex metal framework for clamping two consecutive cover elements and comprising an integral wall defining two narrow opposed insert cavities, each cavity being limited at its upper part by a horizontal plane 26 and at its lower part by an oblique plane (27); a detachable corner piece (28) inserted into each cavity such that a cover element (13) is gripped between the horizontal plane (26) and a detachable corner piece (28); and a flexible strip inserted between the oblique plane (27) and the detachable corner piece (28) said flexible strip having a short section and a long section, the ends of which contact the oblique plane (27), and a median portion formed integral with and located between said short and long sections, said median portion contacting the detachable corner piece (28) so as to bias said detachable corner against said cover element (13).

* * * * *